US006773033B1

(12) United States Patent
Fügel

(10) Patent No.: US 6,773,033 B1
(45) Date of Patent: Aug. 10, 2004

(54) MOBILE CONCRETE PUMP COMPRISING TELESCOPIC SUPPORT ARMS

(75) Inventor: Dietmar Fügel, Winkelwiesen (DE)

(73) Assignee: Putzmeister Aktiengesellschaft (DE)

( * ) Notice: Subject to any disclaimer, the term of this patent is extended or adjusted under 35 U.S.C. 154(b) by 192 days.

(21) Appl. No.: 10/181,075

(22) PCT Filed: Nov. 25, 2000

(86) PCT No.: PCT/EP00/11740

§ 371 (c)(1),
(2), (4) Date: Jul. 12, 2002

(87) PCT Pub. No.: WO01/51403

PCT Pub. Date: Jul. 19, 2001

(30) Foreign Application Priority Data

Jan. 12, 2000 (DE) ..... 100 00 814

(51) Int. Cl.[7] ..... B66C 23/78

(52) U.S. Cl. ..... 280/763.1; 280/765.1; 212/302; 212/304

(58) Field of Search ..... 280/763.1, 764.1, 280/765.1, 766.1, 124.134, 43.17, 43.23; 212/301, 302, 303, 304, 305, 306; 137/615; 141/387

(56) References Cited

U.S. PATENT DOCUMENTS 5,638,967 A * 6/1997 Heckmann ..... 212/302
5,706,960 A * 1/1998 Pitman et al. ..... 212/304
6,276,718 B1 * 8/2001 Wolfram et al. ..... 280/765.1
6,308,985 B1 * 10/2001 Wolfram ..... 280/766.1
6,390,504 B1 * 5/2002 Fetzer ..... 280/763.1
6,484,752 B1 * 11/2002 Ebinger et al. ..... 137/615

* cited by examiner

*Primary Examiner*—Brian L. Johnson
*Assistant Examiner*—Bridget Avery
(74) *Attorney, Agent, or Firm*—Pendorf & Cutliff

(57) ABSTRACT

A mobile concrete pump including a chassis (10), a rotating gear (14) for a distributing boom which is mounted onto said chassis, a pump assembly and a supporting construction (20). The supporting construction comprises two arc-shaped telescopic guides (32) for arc-shaped support arms (22) that can be retracted into the chassis and extended obliquely outwards in front. The telescopic guides (32) cross each other on different horizontal planes. Their geometric centers of curvature (36) are mirror-symmetrical in relation to the longitudinal axis (38) of the chassis and lie at a lateral distance from the edges of the longitudinal sides outside said chassis (10), behind an imaginary connecting line drawn between the rear ends (42) of the telescopic guides (32). The inventive supporting construction (20) permits large construction stances to be achieved with simple means, said stances also being suitable for distributing booms in the 50 m class.

7 Claims, 1 Drawing Sheet

MOBILE CONCRETE PUMP COMPRISING TELESCOPIC SUPPORT ARMS

CROSS REFERENCE TO RELATED APPLICATION

This application is a national stage of PCT/EP00/11740 filed Nov. 25, 2000 and based upon DE 100 00 814.3 filed Jan. 12, 2000 under the International Convention.

BACKGROUND OF THE INVENTION

1. Field of the Invention

The invention concerns a mobile concrete pump with at least one front axle and at least one rear axle associated with a chassis, with a rotation gear for the distribution boom provided on the chassis near the front axle, with a pump assembly mounted on the chassis and separated from the rotation gear in the direction of the rear axle by a free space, with a vehicle chassis support structure which comprises two curved telescopic guides fixed to the chassis into which two curved support struts can be retracted and from which they can also be diagonally extended towards the front, wherein the telescopic guides extend in horizontal planes in an area between the two longitudinal sides of the chassis and exhibit geometric curvatures about respective center points, which center points are distanced sideways from the longitudinal side edges outside of the vehicle chassis and mirror symmetric to the vehicle chassis.

2. Description of the Related Art

A mobile concrete pump of this type is known (EP-B-661196), wherein the telescopic guides extend respectively from one of the longitudinal side edges of the chassis towards inwards essentially to the vehicle center, and from there to the same longitudinal side edge, whereby the vehicle longitudinal axis runs tangential to the guides. The geometric center the curvature (center of a circle described by the arc) herein lies mirror symmetric to the vehicle longitudinal axis, distanced sideways from the longitudinal side edges outside of the vehicle chassis, and mainly forwards (in the vehicle driving direction) of an imaginary connecting line extending between the rearward ends of the telescopic guides. For this telescopic guide, less than one half of the vehicle breadth is available. The exit side tangential angle of the telescopic guides is correspondingly small in comparison to the adjacent longitudinal side edges. In practically realized cases it corresponds to less than 40°. In order to nevertheless achieve a sufficient stance or setup breadth, relatively small curvature radiuses are required in the support struts, which typically lie within the 1.6 to 1.8 multiple of the vehicle chassis breadth. These relatively small curvature radiuses limit the maximal possible extension width to a relatively small value. On the other hand, the high torsional load of the support struts in this case require a stiffening or rigidifying with great investment in material.

SUMMARY OF THE INVENTION

Beginning therewith, it is the task of the present invention to improve the known mobile concrete pumps with telescopic support struts of the above described type in such a manner that with a given vehicle chassis breadth a large support width can be achieved with simple means.

The inventive solution uses the entire vehicle chassis breadth for the storage or mounting of the telescopic guides. Only therewith does it become possible to increase the curvature radius in the support struts, and therewith to achieve suitably large support breadths even for large distribution booms. In order to accomplish this it is proposed in accordance with the invention that the two telescopic guides cross in different planes in the area of the rotation gear, or in the free space between the rotation gear and the concrete pump, and that the geometric curvature center point of the telescopic guides (center of circle described by arc of telescopic guides) is aft of an imaginary connecting line extending between the rearward ends of the telescopic guides. The curvature radius of the telescopic guides achievable therewith is larger than two times the vehicle chassis breadth. Preferably, the relationship of radius of curvature to vehicle chassis breadth is between 2.2 and 3.2. It is further of advantage when the telescopic guides on the exit side in the area of the longitudinal side edges enclose a tangential angle with respect to the adjacent longitudinal side edge of 40° to 70°.

Preferably the tangential angle of the exit side lies between 45° and 60°. At their rearward ends the telescopic guides preferably form with the adjacent longitudinal side edge a tangential angle of 1° to 25°. The preferred rearward tangential angle lies in the range between 2.5° and 20°.

The additionally required rearward support struts are preferably formed as pivot struts, which are pivotably connected rearward of the telescopic guides. In place of pivot struts it is however also possible to use telescopic support struts arranged or provided transverse or diagonal to the vehicle chassis longitudinal axis.

BRIEF DESCRIPTION OF THE DRAWINGS

In the following the invention will be described in greater detail on the basis of the illustrative embodiments represented schematically in the drawings. There is shown FIG. 1 a top view upon a mobile concrete pump with relatively small distribution boom and accordingly smaller center of gravity circle or footprint.

DETAILED DESCRIPTION OF THE INVENTION

Figure 1:
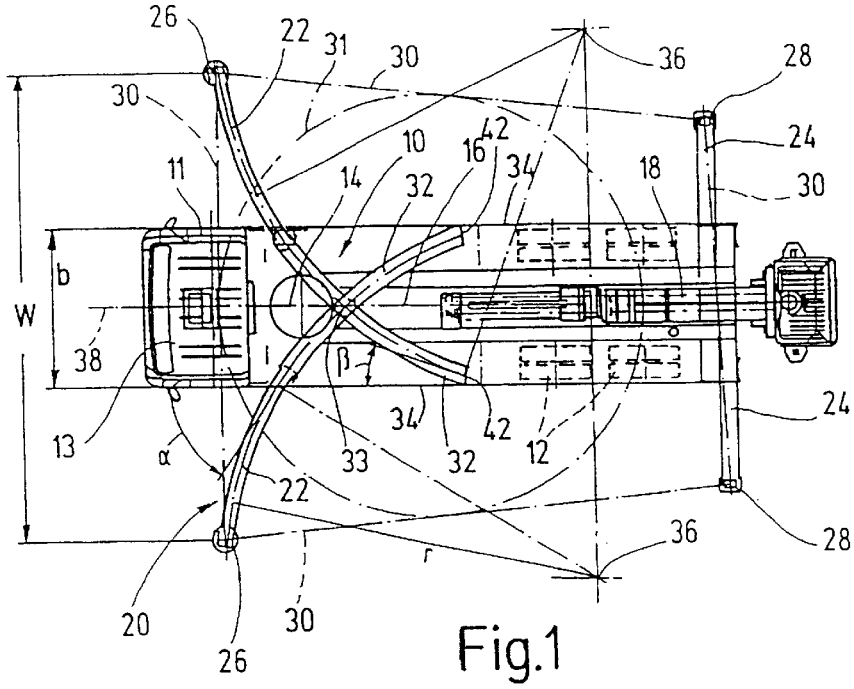
Figure 2:
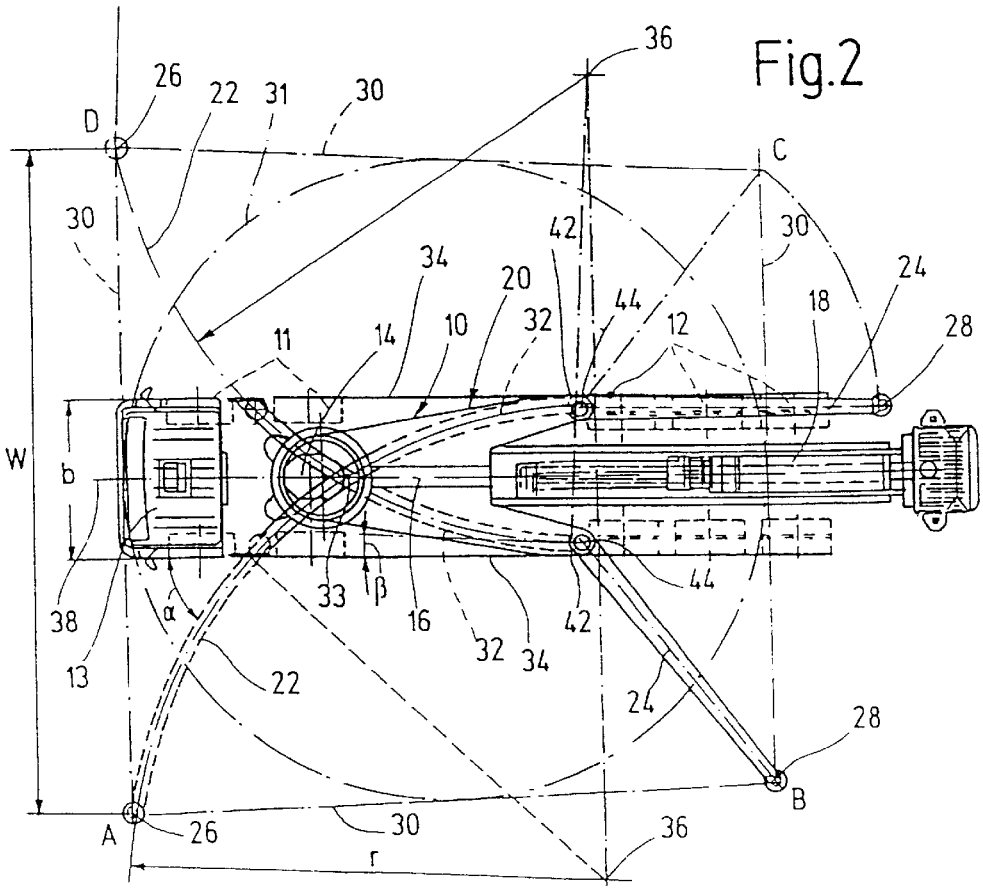
FIG. 2 a top view upon a mobile concrete pump with larger distribution boom and accordingly larger center of gravity circle or footprint.

The mobile concrete pumps shown in the drawings are comprised essentially of a vehicle chassis 10 with at least one forward axle 11 and at least one rearward axle 12, with a driver cabin 13, a rotation gear 14 near the forward axis and a concrete placing boom mounted rotatably about a vertical axis, not shown, with a pump 18 mounted on the vehicle chassis 10 separated from the rotation gear 14 by a free space 16, as well as a support assembly 20 for the vehicle chassis 10. The support assembly 20 includes two support struts 22 near the forward axle and two support struts 24 near the rearward axle, which in the driving condition of the vehicle are retracted and in the working state are extended and supported upon the ground via their foot parts 26, 28. The foot parts 26, 28 in their extended state define the tip-boundaries 30 of the system, which must be so positioned, that the center of gravity of the concrete pump in all configurations of the placing boom lies within these tip edges 30. In FIGS. 1 and 2 this is indicated respectively by the center-of-gravity circle 31, which defines the geometric location of the center of gravity of the system during horizontally extended placement boom in all of its rotation positions about the rotating gear axis. FIG. 1 shows the geometric relationship of a concrete pump with placement boom of approximately 30 m length, while FIG. 2 illustrates the geometric relationship of a concrete pump with a boom length of approximately 50 m.

In both illustrative embodiments the forward support struts 22 are in the form of arc-shape, bent telescope segments, which are guided in correspondingly arc curved vehicle chassis fixed telescope guides 32. The telescope guides 32 cross in different horizontal planes in the area between the two longitudinal side edges 34 of the vehicle chassis 10, wherein the crossing point 33 is located in the free space 16 between rotating gear 14 and pump assembly 18. The geometric curvature center point 36 of the telescopic guides 32 and the associated support struts 22 is mirror symmetric to the longitudinal axis 38 of the vehicle chassis 10 distanced from the longitudinal side edges 34 outside of the vehicle chassis 10 and is always located behind an imaginary connecting line extending transverse to the longitudinal axis 38 between the rear ends 42 of the telescopic guides 32. The curvature radius r corresponds in the illustrative embodiment according to FIG. 1 to the 2.3 multiple and in the case of FIG. 2 approximately the 3-fold of the vehicle chassis breadth. The telescope guides 32 are besides this so arranged on the vehicle chassis, that their exit side tangential angle a relative to the adjacent longitudinal side edge 34 in the case of FIG. 1 corresponds to approximately 57.5° and in the case of FIG. 2 to approximately 46.5°, while the rearward tangential angle β in the case of FIG. 1 corresponds to 20° and in the case of FIG. 2 to approximately 3°. Taking into consideration these geometric relationships one achieves a support width W of the forward support struts, which in the case of FIG. 1 corresponds to approximately the 2.9 multiple and in the case of FIG. 2 to the 4.2 multiple of the vehicle chassis breadth b, wherein in the later case the forward tip boundary 30 of the support assembly coincides with the leading edge of the vehicle chassis. Such support widths cannot be achieved with conventional support designs with simple telescope assemblies. In addition, on the basis of the relatively large curvature radius the torsional load on the support struts 22 and in the associated telescope guides 32 is maintained within limits.

The support struts 24 near the rearward axles are constructed in the illustrative embodiment according to FIG. 1 as telescopic struts arranged transverse to the vehicle axis, while in the case of FIG. 2 they are formed as pivot struts. The pivot struts according to FIG. 2 are pivotably about a vehicle fixed vertical axis 44, linked in the area of the rearward end 42 of the telescopic guides 32.

In summary the following can be concluded: The invention relates to a mobile concrete pump comprising a chassis 10, a rotation gear 14 for a distributing boom which is mounted onto said chassis, a pump assembly and a supporting construction 20. The supporting construction comprises two arc-shaped telescopic guides 32 for arc-shaped support arms 22 that can be retracted into the chassis and extended obliquely outwards in front. The telescopic guides 32 cross each other on different horizontal planes. Their geometric centers of curvature 36 are mirror-symmetrical in relation to the longitudinal axis 38 of the chassis and lie at a lateral distance from the edges of the longitudinal sides outside said chassis 10, behind an imaginary connecting line drawn between the rear ends 42 of the telescopic guides 32. The inventive supporting construction 20 permits large construction bases to be achieved with simple means, said bases also being suitable for distributing booms in the 50 m class.

What is claimed is:

1. Mobile concrete pump on a vehicle chassis (10) having at least one forward axle (11) and at least one rearward axle (12), a rotation gear (14) for a placement boom provided upon the vehicle chassis (10) near the forward axle, a pump assembly (18) mounted upon the vehicle chassis (10) separated from the rotation gear (14) by a free space (16) in the direction of the rear axle (12), a support assembly (20) which includes two vehicle chassis fixed arc-shaped telescopic guides (32) for curved support struts (22) which can be retracted therein or extended obliquely forwards, wherein the telescopic guides (32) extend in horizontal planes in the area between two longitudinal side edges (34) of the vehicle chassis (10) and exhibit geometric curvature center points (36), which points lie mirror symmetric to the longitudinal axis (38) of the vehicle chassis (10) distanced from the longitudinal side edges (34) outside of the vehicle chassis, wherein the two telescopic guides (32) cross each other at different planes in the area of the rotation gear (14) or in the free space (16) between the rotation gear (14) and pump assembly (18), and that the geometric curvature center point (36) lies behind an imaginary connecting line connecting the rearward ends (42) of the telescopic guides (32).

2. Mobile concrete pump according to claim 1, wherein the curvature radius (r) of the telescopic guides (32) is larger than two times the vehicle chassis breadth (b).

3. Mobile concrete pump according to claim 1, wherein the telescopic guides (32) enclose at their outlet sides a tangential angle, relative to the adjacent longitudinal side edge (34), of 40° to 70°.

4. Mobile concrete pump according to claim 1, wherein the telescopic guides (32) at their rearward ends (42) enclose, with the adjacent longitudinal side edges (34), a tangential angle of 1° to 25°.

5. Mobile concrete pump according to claim 2, wherein the relationship of the curvature radius (r) to the vehicle chassis breadth (b) is between 2.2 and 3.2.

6. Mobile concrete pump according to claim 3, wherein the outlet side tangential angle corresponds to 45° to 60°.

7. Mobile concrete pump according to claim 4, wherein the rearward tangential angle corresponds to 2.5° to 20°.

* * * * *